US009251991B2

(12) United States Patent
Kakutani et al.

(10) Patent No.: US 9,251,991 B2
(45) Date of Patent: Feb. 2, 2016

(54) LASER ION SOURCE

(71) Applicant: KABUSHIKI KAISHA TOSHIBA, Tokyo (JP)

(72) Inventors: Akiko Kakutani, Yokohama (JP); Kazuo Hayashi, Yokohama (JP); Akihiro Osanai, Yokohama (JP); Kiyokazu Sato, Tokyo (JP); Takeshi Yoshiyuki, Yokohama (JP); Tsutomu Kurusu, Tokyo (JP)

(73) Assignee: KABUSHIKI KAISHA TOSHIBA, Tokyo (JP)

( * ) Notice: Subject to any disclaimer, the term of this patent is extended or adjusted under 35 U.S.C. 154(b) by 0 days.

(21) Appl. No.: 13/777,237

(22) Filed: Feb. 26, 2013

(65) Prior Publication Data

US 2013/0221234 A1 Aug. 29, 2013

(30) Foreign Application Priority Data

Feb. 29, 2012 (JP) ..... 2012-043816

(51) Int. Cl.
*H01J 27/24* (2006.01)
*H01J 49/16* (2006.01)

(52) U.S. Cl.
CPC ..... *H01J 27/24* (2013.01); *H01J 49/161* (2013.01); *H01J 49/162* (2013.01); *H01J 49/164* (2013.01)

(58) Field of Classification Search
CPC ..... H01J 27/24; H01J 27/022; H01J 49/161; H01J 49/162; H01J 49/164; G21K 5/00; G21K 5/04
USPC ..... 250/423 P, 492.3, 423 R, 424, 425
See application file for complete search history.

(56) References Cited

U.S. PATENT DOCUMENTS 4,554,610 A * 11/1985 Metz et al. ..... 361/144
5,258,047 A * 11/1993 Tokisue et al. ..... 29/25.01
5,498,545 A * 3/1996 Vestal ..... 436/47
7,906,769 B2 * 3/2011 Blasche et al. ..... 250/492.3

(Continued)

FOREIGN PATENT DOCUMENTS

CN 1828818 A 9/2006
CN 101385116 A 3/2009

(Continued)

OTHER PUBLICATIONS

Office Action issued Mar. 2, 2015 in Chinese Patent Application No. 201310063330.0 (with English-language Translation).

(Continued)

*Primary Examiner* — Jack Berman
*Assistant Examiner* — Kevin Chung
(74) *Attorney, Agent, or Firm* — Oblon, McClelland, Maier & Neustadt, L.L.P.

(57) ABSTRACT

According to one embodiment, there is provided a laser ion source. The laser ion source includes a vacuum chamber which is vacuum-exhausted and in which a target is transported and set, a valve which is opened when the target is transported into the vacuum chamber and is closed except for the transportation, a target supply chamber which holds the target to be movable, and a transportation unit which transports to the vacuum chamber the target held on the target supply chamber while opening the valve after the target supply chamber is vacuum-exhausted while closing the valve.

5 Claims, 3 Drawing Sheets

(56) References Cited

U.S. PATENT DOCUMENTS

| | | | | |
|---|---|---|---|---|
| 2008/0029297 | A1 | 2/2008 | Nakamura | |
| 2008/0290297 | A1* | 11/2008 | Blasche et al. | 250/492.3 |
| 2009/0230318 | A1* | 9/2009 | Fourkal et al. | 250/423 R |
| 2010/0051828 | A1* | 3/2010 | Doemer et al. | 250/492.1 |
| 2011/0248181 | A1* | 10/2011 | Zigler | G21G 1/10 250/423 P |

FOREIGN PATENT DOCUMENTS

| | | |
|---|---|---|
| JP | 56-40235 | 4/1981 |
| JP | 61-114545 | 6/1986 |
| JP | 4-63644 | 5/1992 |
| JP | 5-230625 | 9/1993 |
| JP | 2002-334428 | 11/2002 |
| JP | 2004-140297 | 5/2004 |
| JP | 3713524 | 9/2005 |
| JP | 2007-270284 | 10/2007 |
| JP | 2007-305560 | 11/2007 |
| JP | 2008-503037 | 1/2008 |
| JP | 2008-504669 | 2/2008 |
| JP | 2008-98081 | 4/2008 |
| JP | 2009-37764 | 2/2009 |
| JP | 2011-3887 | 1/2011 |

OTHER PUBLICATIONS

Office Action mailed Apr. 22, 2014, in Japanese Patent Application No. 2012-043816 filed Feb. 29, 2012 (with English-language Translation).

Hirotsugu Kashiwagi, et al., "Acceleration of High Current and Higly Charged Carbon Beam Using Direct Injection Scheme," Proceedings of the 2nd Annual Meeting of Particle Accelerator Society of Japan and the 30th Linear Accelerator Meeting in Japan, Tosu Japan, Jul. 20-22, 2005, 5 pages.

* cited by examiner

LASER ION SOURCE

CROSS-REFERENCE TO RELATED APPLICATIONS

This application is based upon and claims the benefit of priority from Japanese Patent Application No. 2012-043816, filed Feb. 29, 2012, the entire contents of which are incorporated herein by reference.

FIELD

Embodiments described herein relate generally to a laser ion source that generates ions by irradiation of a laser beam.

BACKGROUND

In recent years, a therapy method for cancer by high-energy carbon ion irradiation has been developed and a therapy using an ion source that generates an ion beam has been disclosed.

For advanced performance improvement of the ion source, a high-density $C^{6+}$ needs to be generated. However, for example, since an ion source using μ-wave discharge plasma is lack of capability to generate the high-density $C^{6+}$, development of a new ion source is required.

Therefore, a laser ion source having an ability to generate a high-density ion beam has been known. The laser ion source is a device that collects and irradiates a laser beam onto a solid target set in a space that satisfies a predetermined vacuum condition, ionizes the solid target by energy of the laser beam, and electrostatically extracts the ions to generate an ion beam.

A feature of the laser ion source is that the solid target is used as a generation source of the ion. By using the solid target as such, high-density ion current can be extracted in the laser ion source.

However, in the case where the laser ion source is continuously operated, the generation source of the ion (that is, the solid target) needs to be supplied in the laser ion source.

For example, in the ion source using the discharge plasma, gas may be just supplied as the generation source of the ion. In this regard, in the laser ion source, the solid target is generally supplied (exchanged) by releasing the laser ion source to the atmosphere whenever supplying the generation source of the ion (that is, the solid target).

When the laser ion source is applied to a medical service, since a long stabilizing operation is required for the corresponding laser ion source, the target is required to be supplied (exchanged) without damaging the vacuum condition in the space where the solid target (hereinafter, simply referred to as a target), which is the ion generation source is set.

In other words, it is important to establish a consecutive supply method of the target which does not significantly damage the vacuum condition in the laser ion source.

However, when the laser ion source is released to the atmosphere whenever supplying the target, the vacuum condition in the space, where the target is set, is damaged.

Therefore, in the laser ion source, a special device is required to supply the target.

DETAILED DESCRIPTION

Hereinafter, embodiments of the invention will be described with reference to the accompanying drawings. According to one embodiment, in general, there is provided a laser ion source, including: a vacuum chamber which is vacuum-exhausted and in which a target generating ions by irradiation of a laser beam is transported and set; a valve which is provided on a side of the vacuum chamber, and is opened when the target is transported into the vacuum chamber and is closed except for the transportation; a target supply chamber which is attached to the vacuum chamber via the valve, holds the target to be movable, and is vacuum-exhausted independently from the vacuum chamber; and a transportation unit which transports to the vacuum chamber the target held on the target supply chamber while opening the valve after the target supply chamber is vacuum-exhausted while closing the valve.

(First Embodiment)

Figure 1:
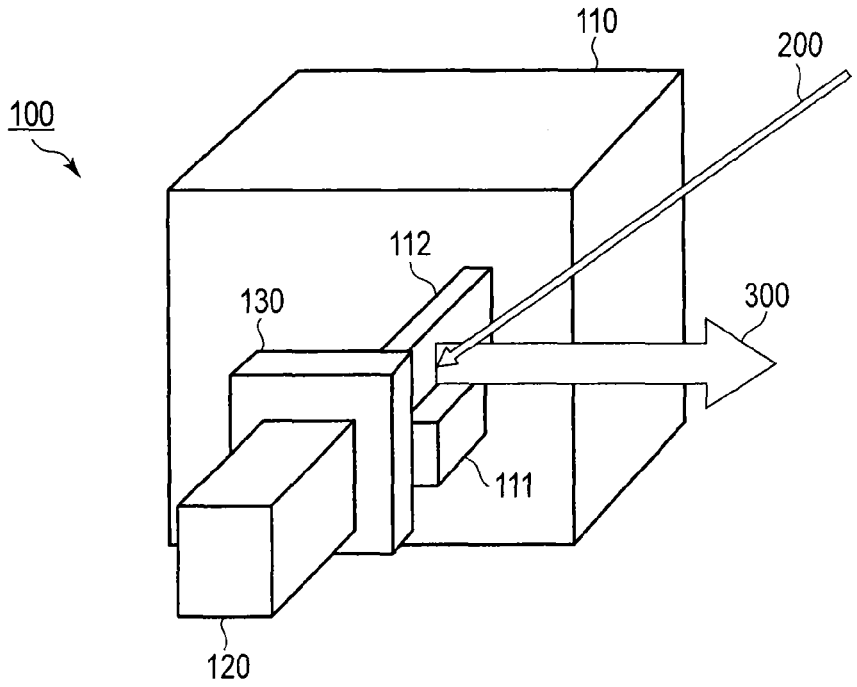
FIG. 1 is a sketch illustrating a schematic configuration of a laser ion source according to a first embodiment of the invention.

FIG. 1 is a sketch illustrating a schematic configuration of a laser ion source according to a first embodiment of the invention.

A laser ion source 100 illustrated in FIG. 1 includes an ion generation vacuum chamber 110, a target supply chamber 120, and a valve (gate valve) 130.

A target shifting device 111 is provided in the ion generation vacuum chamber 110. A target 112 containing an element, which becomes an ion, is transported and set on the target shifting device 111. The target shifting device 111 serves to shift the target 112 so as to change an irradiation position of a laser beam to the target 112. Further, the target 112 is, for example, a carbon based plate-like member.

In addition, although not illustrated in FIG. 1, the ion generation vacuum chamber 110 includes an optical system that collects a laser beam 200 on the surface of the target 112, an acceleration electrode that accelerates the generated ion, and an exhaust system for vacuum-exhausting the ion generation vacuum chamber 110.

The target supply chamber 120 is attached to the ion generation vacuum chamber 110 via the valve 130. The target supply chamber 120 is able to be vacuum-exhausted by the exhaust system (not illustrated), independently from the ion generation vacuum chamber 110.

The valve 130 is provided in a part (a side) of the ion generation vacuum chamber 110 and serves to open/close a flow channel between the ion generation vacuum chamber 110 and the target supply chamber 120. The valve 130 is opened when the target is transported into the ion generation vacuum chamber 110 and closed except for the transportation, for example. Further, in the valve 130, for example, opening/closing is performed by a vacuum cut-off valve.

According to the laser ion source 100, the laser beam 200 is collected and irradiated onto the target 112, and as a result, an ion 300 is generated by energy of the laser beam and the ion 300 is electrostatically extracted, and as a result, an ion beam is generated.

In detail, in the laser ion source 100, the laser beam 200 is collected and irradiated onto the target 112 set in the ion generation vacuum chamber 110, and as a result, a minute fraction of the target 112 becomes hot as a high temperature, is made into plasma, and is emitted to a space, at a point (hereinafter, referred to as an irradiation point) onto which the laser beam is collected and irradiated. Ions in the plasma receive energy even from the laser beam 200, and as a result, multi-charged ions are generated. In the laser ion source 100, the generated ion 300 is accelerated in the acceleration electrode to be extracted as a high-energy ion beam.

Further, since the high-energy laser beam 200 is collected and irradiated onto the target 112, a crater is formed on the surface of the target 112 by one laser irradiation. For stabilization of ion generation in the laser ion source 100, the laser beam 200 may be irradiated onto a new surface of the target 112 whenever the laser beam 200 is collected and irradiated. To this end, in the laser ion source 100, the target 112 may be shifted little by little so as to avoid an irradiation point (the point onto which the laser beam 200 is collected and irradiated) which has been used, by the target shifting device 111.

Further, the center of ablation plume, which is ejected when the laser beam 200 is collected and irradiated onto the target 112, is a normal direction of the irradiation point (irradiation surface). That is, the surface of the target 112 at the irradiation point of the laser beam 200 is set such that a normal erected from the irradiation point matches an axial direction (a direction to generate the ion 300) which is mechanically determined in the laser ion source 100. Hereinafter, the axis, which is mechanically determined in the laser ion source 100, is referred to as an ion axis.

For example, in the case where the laser beam 200 is irradiated onto all surfaces of the target 112 by little by little shifting the target 112 with the target shifting device 111 as described above, the target 112 set in the ion generation vacuum chamber 110 (on the target shifting device 111) needs to be exchanged (that is, a new target 112 needs to be supplied).

Figure 2:
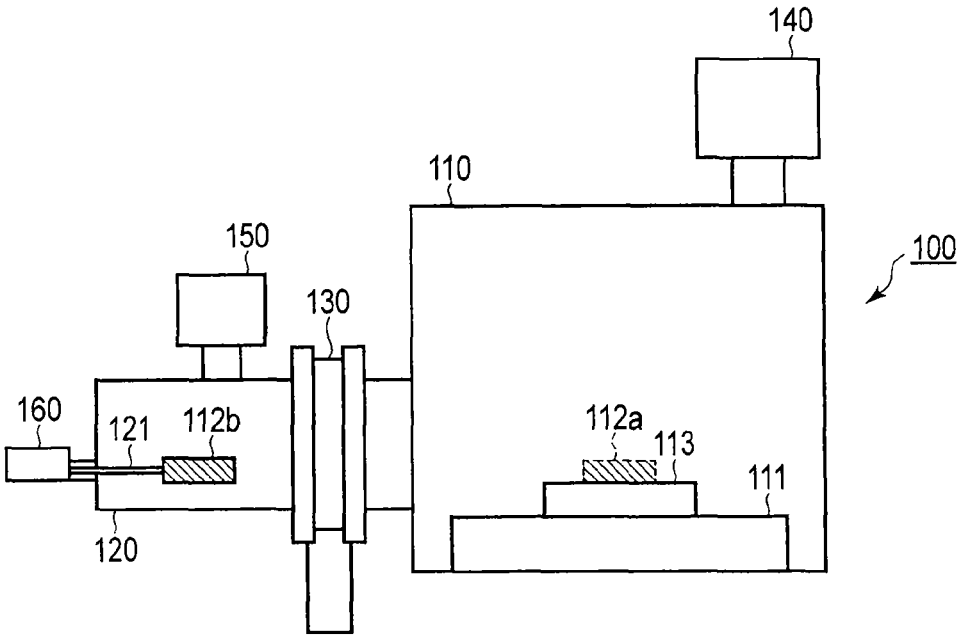
FIG. 2 is a side view for describing an operation when supplying a target in a laser ion source according to the embodiment of the invention.

Hereinafter, referring to FIG. 2, an operation when supplying the target 112 in the laser ion source 100 according to the embodiment will be described. Further, FIG. 2 is a side view illustrating the laser ion source 100 illustrated in FIG. 1 from a generation (emission) direction of the ion 300. In addition, in FIG. 2, a transportation system and an acceleration electrode of an ion of the laser beam 200 are omitted.

Herein, a case in which all surfaces of a target 112*a* set in the ion generation vacuum chamber 110 are collected and irradiated by the laser beam 200 (that is, a case in which the target 112*a* needs to be exchanged) is assumed. In this case, it is assumed that the ion generation vacuum chamber 110 is vacuum-exhausted by a vacuum exhausting device 140 provided in the ion generation vacuum chamber 110. Further, it is assumed that the valve 130 is in a closed state (hereinafter, referred to a closed state).

Hereinafter, the used target 112*a*, which is exchanged, is referred to as the used target 112*a*.

In this case, the target supply chamber 120 is vacuum-exhausted by a vacuum exhausting device 150 provided in the target supply chamber 120.

Subsequently, after the valve 130, which connects the ion generation vacuum chamber 110 and the target supply chamber 120, is in the opened state (hereinafter, referred to as the opened state), the used target 112*a*, which is set in the ion generation vacuum chamber 110, is drawn up to the target supply chamber 120 by, for example, a transportation rod inserted into the ion generation vacuum chamber 110 from the target supply chamber 120.

Thereafter, the valve 130 is in the closed state and the target supply chamber 120 is released to the atmosphere. The used target 112*a*, which is drawn up to the target supply chamber 120, is exchanged with a target 112*b* (hereinafter, referred to as a supplying target) which is newly supplied into the ion generation vacuum chamber 110. As a result, the supplying target 112*b* is held (set) in the target supply chamber 120 to be movable. A front end of a transportation rod 121 (a rod-shaped member) is attached to the supplying target 112*b*. Further, a target transporting device 160 for transporting the supplying target 112*b* to the ion generation vacuum chamber 110 is connected to the other end of the transportation rod 121.

In addition, since the valve 130 is in the closed state as described above, the ion generation vacuum chamber 110 is maintained in a vacuum-exhausted state even during an operation in which the supplying target 112*b* is set in the target supply chamber 120.

In the case where the supplying target 112*b* is set in the target supply chamber 120 as described above, the target supply chamber 120 is vacuum-exhausted by the vacuum exhausting device 150.

Subsequently, the valve 130 is in the opened state at the time when an internal pressure of the target supply chamber 120 is equal to or lower than an internal pressure of the ion generation vacuum chamber 110 by vacuum-exhaustion of the vacuum exhausting device 150, and the supplying target 112*b* is transported into the ion generation vacuum chamber 110 by the target transporting device 160 and the transportation rod 121.

Herein, the target shifting device 111 is provided in the ion generation vacuum chamber 110 as described and a target shifting stand 113 is installed in the target shifting device 111.

The supplying target 112*b* transported to the ion generation vacuum chamber 110 is fixed to the target shifting stand 113 and shifted with high precision by the target shifting device 111 such that the normal direction of the irradiation point (irradiation surface) matches the aforementioned ion axis direction.

That is, when the supplying target 112*b* is supplied in the laser ion source 100 according to the embodiment, the valve 130 is in the closed state while the ion generation vacuum chamber 110 and the target supply chamber 120 are in the vacuum exhaustion state and only the target supply chamber 120 is released to the atmosphere. When the supplying target 112*b* is set in the target supply chamber 120, the target supply chamber 120 is vacuum-exhausted again and thereafter, the valve 130 is in the opened state and the supplying target 112*b* is transported into the ion generation vacuum chamber 110. As a result, the supplying target 112*b* may be supplied to the ion generation vacuum chamber 110 without releasing the ion generation vacuum chamber 110 to the atmosphere.

Further, the target shifting device 111 provided in the ion generation vacuum chamber 110 includes, for example, an electric actuator. In the case where a motor of an electric actuator is installed in the ion generation vacuum chamber 110, power is supplied from the outside of the ion generation vacuum chamber 110 and rotation of the motor is controlled. In addition, (A surface of) the target 112 installed in the ion generation vacuum chamber 110 may be in a surface vertical to the ion axis which is mechanically determined in the laser ion source 100 and a shifting direction of the target 112 by the target shifting device 111 may be one direction or two directions.

In addition, the target 112 may be shifted by a linear introducer which is operable from the outside of the ion generation vacuum chamber 110 or shifted by a rotational introducer which is operable from the outside of the ion generation vacuum chamber 110 and a gear installed in the ion generation vacuum chamber 110.

As described above, in the embodiment, it is possible to supply the target 112 without damaging the vacuum condition by the configuration to include the ion generation vacuum chamber 110 vacuum-exhausted, in which a target generating ions by irradiation of the laser beam 200 is transported and set, the valve 130 provided on the side of the ion generation vacuum chamber 110, and opened when the target 112 is transported into the ion generation vacuum chamber 110 and closed except for the transportation, the target supply chamber 120 which is attached to the ion generation vacuum chamber 110 via the valve 130, holds the target 112 to be movable, and is vacuum-exhausted independently from the ion generation vacuum chamber 110, and the target transporting device 160 which transports to the ion generation vacuum chamber 110 the target 112 held on the target supply chamber 120 while opening the valve 130 after vacuum-exhausting the target supply chamber 120 while closing the valve 130.

Further, in the embodiment, the target 112 (112*a* and 112*b*) of a quadrangular prism (plate-like member) is used as illustrated in FIGS. 1 and 2, but the target 112 may be a polygonal prism other than the quadrangular prism and may be shaped like, for example, a cylinder.

(Second Embodiment)

Figure 3:
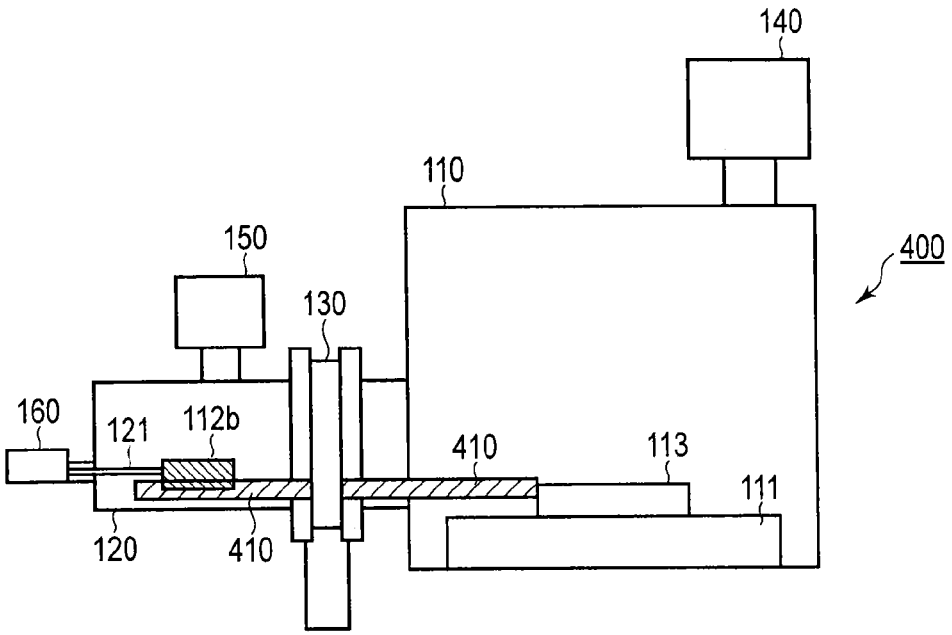
FIG. 3 is a side view for describing an operation when supplying a target in a laser ion source according to a second embodiment.
Figure 4:
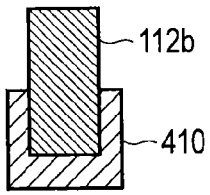
FIG. 4 is a cross-sectional view illustrating an example of a combination of a supplying target and a guide rail.
Figure 5:
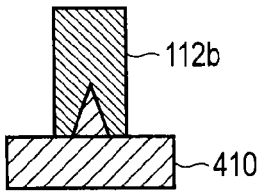
FIG. 5 is a cross-sectional view illustrating an example of a combination of a supplying target and a guide rail.
Figure 6:
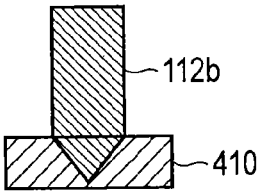
FIG. 6 is a cross-sectional view illustrating an example of a combination of a supplying target and a guide rail.
Figure 7:
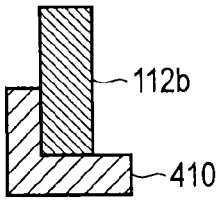
FIG. 7 is a cross-sectional view illustrating an example of a combination of a supplying target and a guide rail.
Figure 8:
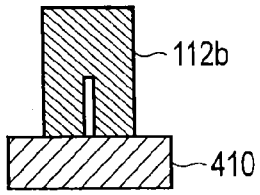
FIG. 8 is a cross-sectional view illustrating an example of a combination of a supplying target and a guide rail.

Subsequently, a second embodiment of the invention will be described with reference to FIG. 3. In FIG. 3, the same reference numerals refer to the same element as FIG. 2 (and FIG. 1) and a detailed description will be omitted. Herein, elements different from those of FIG. 2 will be primarily described.

Further, FIG. 3 is a side view illustrating a laser ion source 400 from a generation (emission) direction of the ion according to the embodiment.

As illustrated in FIG. 3, in the laser ion source 400 according to the embodiment, a guide rail 410 is installed from a target supply chamber 120 to the ion generation vacuum chamber 110. The guide rail 410 is provided to define a transportation direction of a supplying target 112*b*. Further, the guide rail 410 is divided at the position of a valve 130 so as not to interrupt opening/closing of the valve 130.

In the embodiment, the guide rail 410 is provided, and as a result, the supplying target 112*b* is transported to an ion generation vacuum chamber 110 along the guide rail 410. Therefore, the supplying target 112*b* is accurately mounted on a target shifting stand 113 installed in a target shifting device 111.

Further, the supplying target 112*b* and the guide rail 410 in the embodiment may be used by a combination of structures in which the supplying target 112*b* is certainly transportable in a stable state.

Herein, FIGS. 4 to 8 illustrate an example of a combination (that is, an attachment method) of the supplying target 112*b* and the guide rail 410. Further, FIGS. 4 to 8 are cross-sectional views of the supplying target 112*b* and the guide rail 410 on a surface vertical to a traveling direction of the supplying target 112*b*.

As illustrated in FIGS. 4 to 8, the supplying target 112*b* engages in the guide rail 410 according to the structure of the supplying target 112*b*, and as a result, the supplying target 112*b* and the guide rail 410 may be configured so as not to cause positional gap, for example, in a horizontal direction.

Further, since the embodiment is the same as the first embodiment except that the supplying target 112*b* is transported along the guide rail 410, a detailed description thereof will be omitted.

In the embodiment as described, the supplying target 112*b* may be accurately mounted (transported) onto the target shifting stand 113 in the stable state by the configuration in which the supplying target 112*b* is transported along the guide rail 410 installed from the target supply chamber 120 to the ion generation vacuum chamber 110.

Further, in the embodiment, by the configuration in which the guide rail 410 is divided at the position of the valve 130, the guide rail 410 may be avoided from interrupting opening/closing of the valve 130 even in the case where the guide rail 410 is provided.

(Third Embodiment)

Subsequently, a third embodiment of the invention will be described with reference to FIG. 9. Further, since a schematic configuration of the laser ion source according to the embodiment is the same as that according to the first embodiment, the schematic configuration will be appropriately described by using FIGS. 1 and 2.

Figure 9:
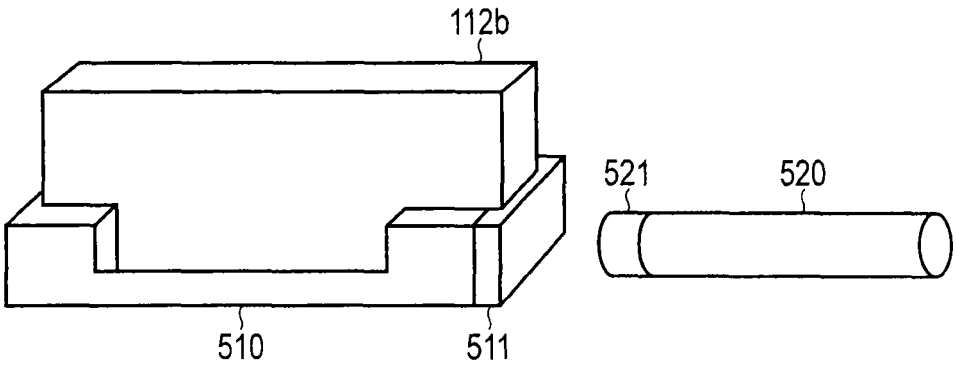
FIG. 9 is a sketch illustrating an example of a target holder and a transportation rod used in a laser ion source according to a third embodiment of the invention.

The embodiment is different from the first embodiment in that a supplying target 112*b* is held on a target holder 510 as illustrated in FIG. 9 and the target holder 510 is transported to an ion generation vacuum chamber 110.

A junction portion 511 of the target holder 510 with a transportation rod 520, which is illustrated in FIG. 9, is made of, for example, a magnetic material. Meanwhile, a magnetic field generating device is mounted on a junction portion 521 (that is, a front end) of the transportation rod 520 with (the junction portion 511 with the transportation rod 520 of) the target holder 510.

By using the transportation rod 520, the target holder 510 holding the supplying target 112*b* may be magnetically captured (suctioned) to be transported.

Further, the target holder 510 is transported to the ion generation vacuum chamber 110 as described above, and as a result, the supplying target 112*b* is mounted on a target shifting stand 113 provided in the ion generation vacuum chamber 110.

In addition, since the embodiment is the same as the first embodiment except that the target holder 510 holding the supplying target 112*b* is transported by using the transportation rod 520, as illustrated in FIG. 9, a detailed description thereof will be omitted.

In the embodiment as described above, it is possible to improve stability of a supply operation of the supplying target 112*b* by the configuration in which the target holder 510 holding the supplying target 112*b* is provided and the target holder 510 is transported to the ion generation vacuum chamber 110.

Further, in the embodiment, the junction portion 511 of the target holder 510 is made of the magnetic material, but the entirety of the target holder 510 may be made of the magnetic material.

Further, in the embodiment, the junction portion 511 of the target holder 510 is made of the magnetic material and the magnetic field generating device is mounted on the junction portion 521 of the transportation rod 520, but a dielectric is used in the junction portion 511 of the target holder 510 instead of the magnetic material and an electrostatic system may be generated in the junction portion 521 of the transportation rod 520. In this case, the target holder 510 holding the supplying target 112*b* may be electrostatically captured (suctioned) to be transported.

In addition, in the embodiment, the junction portion 511 of the target holder 510 is made of the magnetic material and the magnetic field generating device is mounted on the junction portion 521 of the transportation rod 520, and as a result, the target holder 510 is magnetically captured, but for example, the transportation rod 520 is used when the target holder 510 is transported into the ion generation vacuum chamber 110, while the target holder 510 may be mechanically captured by using, for example, a hook, and the like when the target holder 510 is drawn from the ion generation vacuum chamber 110.

Further, when the target holder 510 is transported in the embodiment, the guide rail in the second embodiment may be used.

(Fourth Embodiment)

Figure 10:
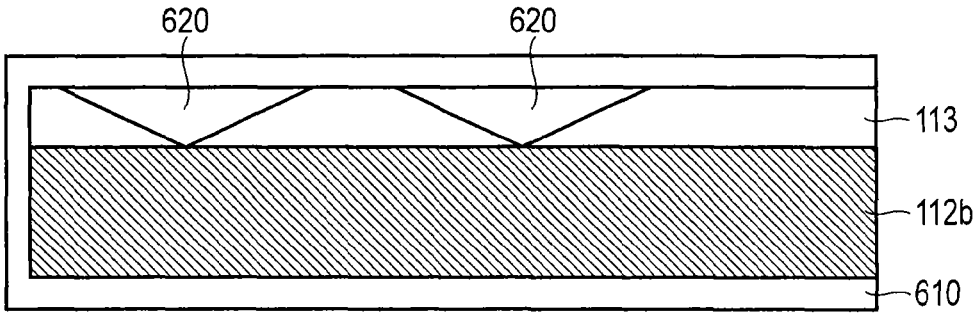
FIG. 10 is a schematic diagram illustrating an example of a fixation mechanism that fixes a target used in a laser ion source according to a fourth embodiment of the invention.

Subsequently, a fourth embodiment of the invention will be described with reference to FIG. 10. Further, since a schematic configuration of the laser ion source according to the embodiment is the same as that according to the first embodiment, the schematic configuration will be appropriately described by using FIGS. 1 and 2.

The embodiment is different from the first embodiment in that (a target shifting stand 113 provided in) a target shifting device 111 includes a fixation mechanism that fixes a supplying target 112*b*.

The supplying target 112*b* transported to an ion generation vacuum chamber 110 from the target supply chamber 120 as described above is mounted on the target shifting stand 113. In this case, the supplying target 112*b* needs to be fixed on the target shifting stand 113 such that the normal direction of the irradiation point (irradiation surface) of the supplying target 112*b* onto which a laser beam 200 is collected and irradiated matches the ion axis direction (the axial direction which is mechanically determined in a laser ion source 100).

Therefore, in the embodiment, a surface 610 (hereinafter, referred to as a reference surface), which is orthogonal to the ion axis, is provided on the target shifting stand 113, as described in FIG. 10 and for example, the reference surface 610 and the supplying target 112*b* are brought into close contact with each other by, for example, an elastic body 620 such a spring. In other words, the supplying target 112*b* is pressed against the direction of the reference surface 610 by the elastic body 620. As a result, the surface of the supplying target 112*b* may be fixed to be orthogonal to the ion axis on the target shifting stand 113.

In the embodiment as described above, it is possible to improve the stability of the generation of the ion beam by the configuration in which the point (irradiation point) of the transported supplying target 112*b* is fixed onto the target shifting stand 113 to be orthogonal to the ion axis direction to generate the ions.

Further, in the embodiment, the supplying target 112*b* is fixed to the target shifting stand 113, but the target holder holding the supplying target 112*b* as described in the third embodiment is brought into close contact with the reference surface 610 to fix the supplying target 112*b*.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A laser ion source that irradiates a laser beam onto a target, which is transported to and set in a vacuum-exhausted vacuum chamber, the target being ionized by the laser beam, the laser ion source electrostatically extracting ions from the target to generate an ion beam, the laser ion source comprising:

a vacuum chamber which is vacuum-exhausted and in which a target generating ions by irradiation of a laser beam is transported and set;

a valve which is provided on the vacuum chamber, and is opened when the target is transported into the vacuum chamber and is closed except for the transportation;

a target supply chamber which is attached to the vacuum chamber via the valve, holds the target to be movable, and is vacuum-exhausted independently from the vacuum chamber; and a transportation unit which transports to the vacuum chamber the target held on the target supply chamber while opening the valve after the target supply chamber is vacuum-exhausted while closing the valve, wherein the transportation unit is configured to transport the target along a guide rail provided between the target supply chamber and the vacuum chamber, the guide rail has a cross sectional profile that corresponds to the target to engage the target so that no gap exists between the target and the guide rail in a cross-sectional view, and the guide rail contacts more than one surface of the target so as to not cause a positional gap in a horizontal direction.

2. The laser ion source according to claim 1, wherein the guide rail is divided at the position of the valve so as not to interrupt the opening/closing of the valve.

3. The laser ion source according to claim 1, wherein the vacuum chamber includes a target shifting unit which shifts the target to change an irradiation position of the laser beam to the transported target.

4. The laser ion source according to claim 3, wherein the target shifting unit includes a fixation unit which fixes the target such that a surface of the transported target is orthogonal to a direction to generate the ion.

5. The laser ion source according to claim 1, wherein the transportation unit transports to the vacuum chamber the target held on the target supply chamber while opening the valve when the pressure of the target supply chamber is equal to or lower than the pressure of the vacuum chamber.

* * * * *